US006319395B1

(12) United States Patent
Kirkbride et al.

(10) Patent No.: US 6,319,395 B1
(45) **Date of Patent: *Nov. 20, 2001**

(54) PROCESS AND APPARATUS FOR CONVERTING OIL SHALE OR TAR SANDS TO OIL

(75) Inventors: Chalmer G. Kirkbride, deceased, late of Bradenton, FL (US), by Chalmer G. Kirkbride, Jr., legal representative; James A. Doyle, Cordova, TN (US); Fred Hildebrandt, Namao (CA)

(73) Assignee: Chattanooga Corporation, Bradenton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/522,475

(22) Filed: Mar. 9, 2000

Related U.S. Application Data

(63) Continuation-in-part of application No. 09/058,184, filed on Apr. 10, 1998, now Pat. No. 6,139,722, which is a continuation-in-part of application No. 08/843,178, filed on Apr. 14, 1997, now Pat. No. 5,902,554, which is a division of application No. 08/551,019, filed on Oct. 31, 1995, now Pat. No. 5,681,452.

(51) Int. Cl.[7] ..... C10G 1/04; C10G 1/06; C10G 1/08

(52) U.S. Cl. ..... 208/418; 208/390; 208/412

(58) Field of Search ..... 208/390, 412, 208/418

(56) References Cited

U.S. PATENT DOCUMENTS

| | | | | |
|---|---|---|---|---|
| 3,001,652 | | 9/1961 | Schroeder et al. | 214/17 |
| 3,030,297 | | 4/1962 | Schroeder | 208/8 |
| 3,093,420 | | 6/1963 | Levene et al. | 302/53 |
| 3,762,773 | | 10/1973 | Schroeder | 302/53 |
| 4,075,081 | * | 2/1978 | Gregoli | 208/418 |
| 4,094,767 | | 6/1978 | Gifford | 208/11 R |
| 4,206,032 | | 6/1980 | Friedman et al. | 208/8 |
| 6,139,722 | * | 10/2000 | Kirkbride et al. | 208/418 |

* cited by examiner

*Primary Examiner*—Walter D. Griffin
*Assistant Examiner*—Tam M. Nguyen
(74) *Attorney, Agent, or Firm*—Morgan & Finnegan, LLP

(57) ABSTRACT

The invention relates to a continuous process for producing synthetic crude oil from oil bearing material, e.g., oil shale or tar sand, through continuous process for producing synthetic crude oil from bituminous tar sand or shale. The process includes treating the tar sand or shale to produce a fluidizable feed, feeding the fluidizable feed to a fluidized bed reactor, and fluidizing and reacting the fluidizable feed in the fluidized bed reactor with substantially only hydrogen.

22 Claims, 9 Drawing Sheets

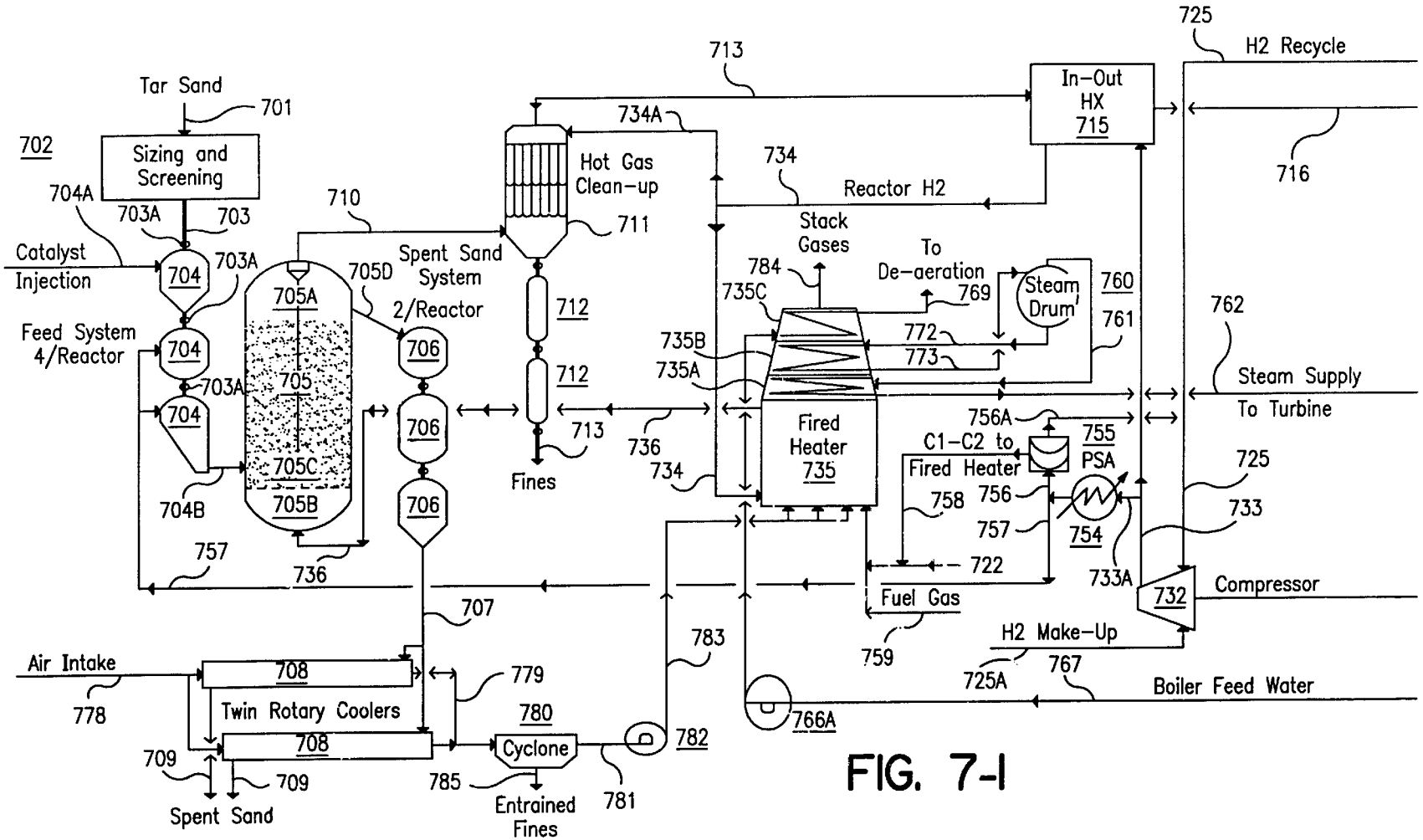
FIG. 7-I

PROCESS AND APPARATUS FOR CONVERTING OIL SHALE OR TAR SANDS TO OIL

RELATED APPLICATIONS

This application is a continuation-in-part of application Ser. No 09/058,184 filed on Apr. 10, 1998, now U.S. Pat. No. 6,139,722 which is a continuation-in-part of application Ser. No. 08/843,178, filed on Apr. 14,1997, now U.S. Pat. No. 5,902,554, which in turn is a division of application Ser. No. 08/551,019, filed Oct. 31, 1995, now U.S. Pat. No. 5,681, 452, each of which is hereby incorporated herein by reference.

FIELD OF THE INVENTION

The present invention relates to a continuous process for producing synthetic crude oil (SCO) from oil shale or tar sand and an apparatus for its practice. More specifically, the present invention provides a process for treating dry tar sand or shale without prior beneficiation, in a reactor operating at elevated pressure and temperature conditions, in the presence of substantially only hydrogen gas.

BACKGROUND OF THE INVENTION

There are some tar sand systems that are successful in making synthetic crude oil (SCO), such as those in the Canadian Athabasca tar sand area that surface mine and process the tar sands, where they first separate sand (85%) from bitumen (15%) to avoid processing the sand in the reaction systems. The separated bitumen is converted to sweet, light crude oil by conventional refinery type operation. Separation of the sand from the bitumen requires beneficiating operations such as floatation cells and secondary separation equipment and processing and equipment to prepare the tar sand for flotation. In these systems, tailing oil recovery is necessary to clear the sand for disposal, however the sand is not completely cleared of bitumen.

Existing technology uses a large number of physical and chemical processing units for the treatment of wet tar sands, e.g., fluid cokers, LC finer, tumblers (being phased out by hydro-pumping), beneficiators including: primary separation vessels with floatation cells and secondary separation systems necessary to recover the bitumen from the tar sand; tailing oil recovery systems which result from the sand not being completely cleared of bitumen; tailing settling ponds which are necessary to settle and separate fine clays and other undesirable solids from the water required for floatation since the water must be reused to maximize clean-up to reduce environmental problems. These systems require large facilities along with the maintenance and reclamation required.

For example, U.S. Pat. Nos. 5,340,467 and 5,316,467 to Gregoli, et al. relate to the recovery of hydrocarbons (bitumen) from tar sands. In the Gregoli, et al. patent process, tar sand is slurried with water and a chemical additive and then the slurry is sent to a separation system. The bitumen recovery from tar sand processes described in U.S. Pat. No. 5,143,598 to Graham et al. and U.S. Pat. No. 4,474,616 to Smith, et al. also involve the formation of aqueous slurries. Other processes involving slurries, digestion, or extraction processes are taught in U.S. Pat. No. 4,098,674 to Rammler, et al., U.S. Pat. No. 4,036,732 to Irani, et al., U.S. Pat. No. 4,409,090 to Hanson, et al., U.S. Pat. No. 4,456,536 to Lorenz, et al. and Miller, et al.

In situ processing of tar sand is also known as seen from the teachings of U.S. Pat. Nos. 4,140,179, 4,301,865 and 4,457,365 to Kasevich, et al. and U.S. Pat. No. 3,680,634 to Peacock, et al.

U.S. Patent No. 4,094,767 to Gifford relates to fluidized bed retorting of tar sands. In the process disclosed by the Gifford patent, raw tar sand is treated in a fluidized bed reactor in the presence of a reducing environment, steam, recycle gases and combustion gases. The conversion of the bitumen, according to the Gifford patent, is through vaporization and cracking, thereby leaving a coked sand product. The steam and oxygen, according to Gifford are "injected into the fluidized bed in the decoking area above the spent sand cooling zone, and below the input area in the cracking zone for fresh tar sand."

The process and apparatus of the present invention avoid the use of the large number of physical and chemical processing units used in the processing of wet tar sand by using a single continuous reactor system to hydrocrack and hydrogenate the dry tar sand. Moreover, because the present invention directly hydrogenates dry tar sand, larger quantities of valuable sweet, light crude oil are obtained. Moreover, with the present invention, less gas and substantially no coke is produced.

BRIEF SUMMARY OF THE INVENTION

The present invention relates to a continuous process for converting oil bearing material, e.g., oil shale or tar sand, and an apparatus for its practice.

Accordingly, one aspect of the present invention is to provide a continuous process and an apparatus for its practice where oil bearing material such as the kerogen in oil shale or the bitumen in tar sand is continuously treated.

Another aspect of the present invention relates to the treatment of dry tar sand.

An object of the present invention is providing a method and apparatus for converting a tar sand or shale feed to oil which can be conducted in the absence of a benificiation processes such as, for example, a hot-water extraction process to separate sand or other non reacting solids from bituminous or oil-bearing material in the feed.

An object of the present invention is providing a process for converting tar sand to oil through the use of substantially only hydrogen.

Another object of the present invention is providing a heat recovery process whereby hydrogen provides the heat necessary to bring the raw tar sand up to reactor temperature.

A still further object of the present invention is providing a process where hydrogen is used for hydrocracking and hydrogenating the bitumen in the tar sand or oil shale.

A further objective of the present invention is providing a process for using recycle and make-up hydrogen as a heat transfer vehicle.

A still further object of the present invention is providing an improved process for producing oil from tar sand or shale by reacting the tar sand or shale with substantially only hydrogen in a fluidized bed reactor, wherein the fluidizing medium is substantially hydrogen.

Yet another object of the present invention is providing a fluidized bed process where one inch or less size tar sand or shale pieces are fed into a fluidized bed reactor near the bottom of the reactor and spent sand and reaction products are removed from near the top of the reactor.

Still another object of the present invention is providing a method of recycling unreacted hydrogen that exits a reactor in which tar sand or oil shale is converted to oil. The method includes purging impurities in the exiting recycle hydrogen stream by pressure swing adsorption, maintaining the hydrogen at more than about 450 psi throughout the recycle process, admixing fresh hydrogen to the recycle hydrogen stream to form a mixture, and feeding the mixture into the reactor.

These objectives can be achieved by providing a process for producing oil from an oil bearing feed such as tar sand or oil shale. The process comprises introducing the feed in a fluidizable form into a fluidized bed reactor. A fluidizing medium enters the fluidized bed reactor where it contacts and fluidizes the fluidizable feed. The fluidizing medium includes at least hydrogen. The fluidized feed forms a fluidized bed where the feed reacts with substantially only the hydrogen at a temperature of at least 900° F. The reaction products include synthetic crude oil and spent solids which are discharged from the fluidized bed reactor.

BRIEF DESCRIPTION OF THE DRAWINGS

In FIGS. 1–6, common elements are similarly identified except for the "figure number" designation. Thus, all elements depicted in FIG. 1, start off with the number 1, e.g., the reactor in FIG. 1 is identified as "104" and in FIG. 2 the same reactor is identified as "204."

DETAILED DESCRIPTION OF THE INVENTION

Figure 1:
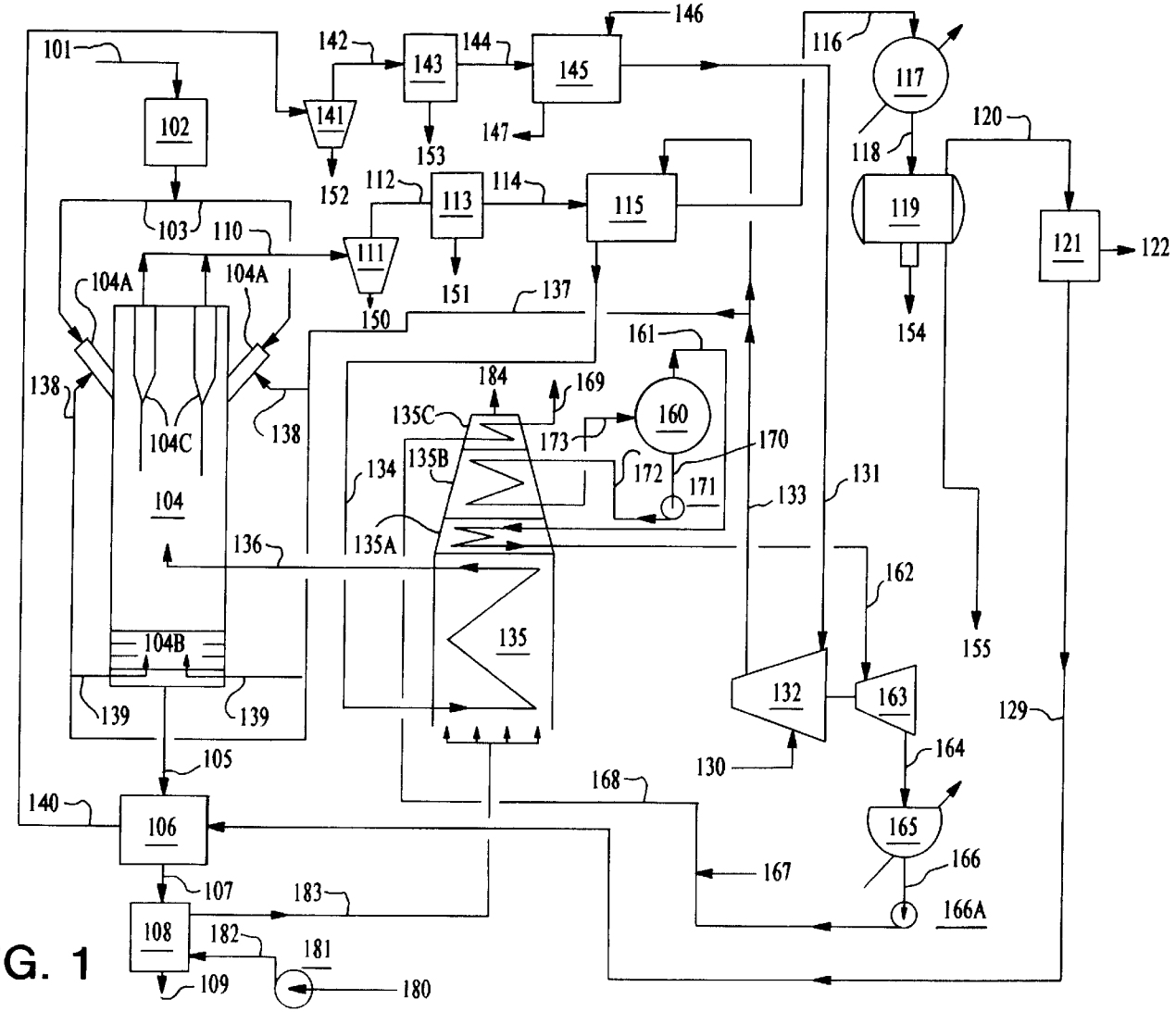
FIG. 1 hows the flow diagram of one embodiment according to the present invention.

In the present invention the hydrocarbon content of the hydrocarbon bearing solids, e.g., dry tar sand or oil shale is reacted in a fluidized bed reactor with hydogen and the process is operated to avoid decompression of the hydrogen. In the present invention, the hydrocarbon bearing solid does not include bituminous or anthracite coals or similar type material. A first portion of a substantially only hydrogen stream is used to feed the oil shale or tar sand, which has been comminuted and reduced in size to form particles that are capable of being fluidized, e.g., fluidizable, into the reactor. A second portion of the hydrogen stream is used as the fluidizing medium. The hydrogen stream that is used in the present invention is formed from fresh make-up hydrogen and recycle hydrogen generated during the process, or obtained from other hydrogen producing processes. A mixed fresh-make-up and recycle hydrogen stream is discharged from a compressor at a first temperature and pressure, and a portion is diverted for admixture with the fluidizable particles of tar sand or oil shale which are injected into the fluidized bed reactor in a fan like flow, at an acute angle relative to the vertical axis of the reactor or a horizontal plane. The remainder of the hydrogen stream at said first temperature is indirectly heated to a second higher temperature by indirect heat exchange with overhead products from the fluidized bed reactor. The hydrogen stream at said second temperature is conveyed to a direct fired heater where the hydrogen stream is heated to a third temperature higher than said second temperature and then used as the fluidizing medium in the reactor to fluidize the tar sand or oil shale fluidizable particles that have been injected with the first portion of the hydrogen stream.

In the fluidized bed reactor the bitumen in the tar sand, or the kerogen in the oil shale, and hydrogen are reacted via endothermic and exothermic reactions to produce spent tar sand or oil shale and an overhead product stream that contains hydrogen, hydrogen sulfide, sulfur gases, $C_1$+$C_2$ hydrocarbons, ammonia, fines (sand particles and clay) and vaporous products. The overhead product stream is first separated in cyclone separators within the reactor which help maintain the bed level and separate solids. The first separated overhead product is conveyed to a series of additional separators to provide a substantially particle free clean product stream. The cleaned product stream at a first temperature is conveyed to a first heat exchange unit where heat is transferred to a second portion of the hydrogen stream and results in a product stream at a second temperature lower than said first product stream temperature. The product stream at said second temperature is conveyed to a condenser to further reduce its temperature to a third temperature lower than the second product stream temperature. The product stream at said third temperature contains liquid and gas fractions and is conveyed to a separator where the gas fraction is removed, sent to an amine scrubber, and recycled as a scrubbed recycle hydrogen stream, and the liquid fraction is removed as oil product (SCO). The cooled, absorbed overhead hydrogen stream is conveyed to a heat exchanger where it contacts spent tar sand or spent shale and its temperature is elevated due to heat transferred from the spent discharge. The hydrogen stream at the elevated temperature is conveyed to a cyclone separator, or other suitable separating devices to remove particles. It then flows to the amine system to regenerate the amine solution. It is eventually conveyed to a compressor where it is combined with fresh make-up hydrogen for use in the fluidized bed reactor as the first and second hydrogen stream portions.

The invention will now be described with reference to the figures. FIG. 1 is a flow chart of one embodiment of the present invention where tar sand is converted to oil. In accordance with the present invention, tar sand from the run of mine conveyor belt 101 is continuously fed to any suitable sizing equipment 102 for classifying tar sand, at a temperature of about 50° F. Tar sand is composed of bitumen and sand.

The bitumen in the tar sand that is processed in the present invention normally contains heavy metals which catalytically help promote the endothermic and exothermic reactions in reactor 104. However, it may be advantageous to add additional catalyst The tar sand processed in accordance with the present invention is exemplified by the following, non-limiting example:

| TAR SAND FEED | | | |
|---|---|---|---|
| sand | | | 84.6 wt. % |
| bitumen | | 15.4 | wt. % |
| | carbon | 83.1 wt. % | |
| | hydrogen | 10.6 wt. % | |
| | sulfur | 4.8 wt. % | |
| | nitrogen | 0.4 wt. % | |

-continued

| TAR SAND FEED | | |
|---|---|---|
| oxygen | 1.1 wt. % | |
| nickel | 75 PPM | |
| vanadium | 200 PPM | |
| | 100 wt. % | 100 wt. % |

Figure 2:
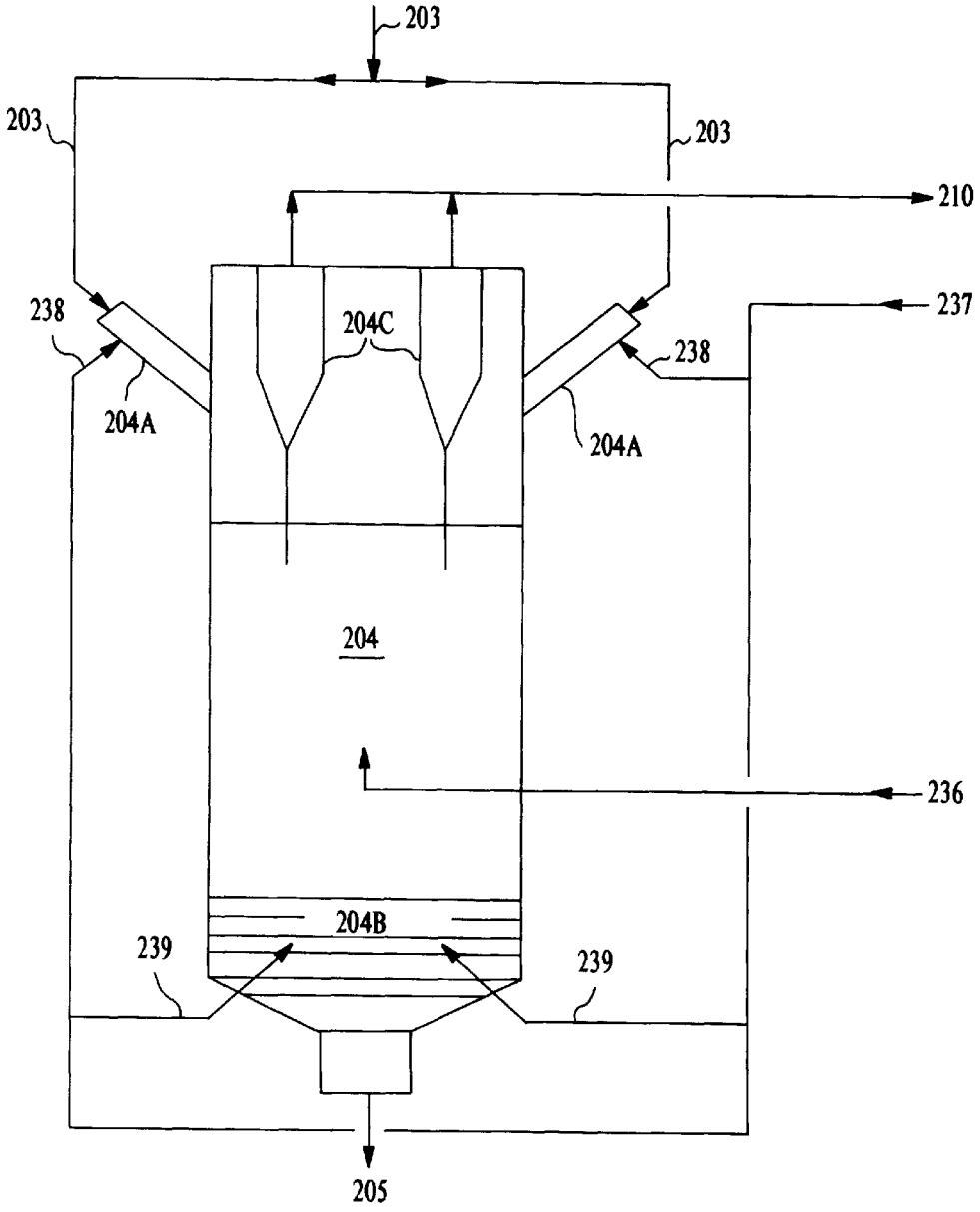
FIG. 2 shows a fluidized bed reactor for converting bitumen in tar sand to viable products in accordance with the present invention.

In the present invention dry tar sand having an average particle size of that of sand is conveyed through conduit 103 as the feed for fluidized bed reactor 104, discussed in greater detail in FIG. 2. Tar sand particles which are oversized are either recycled to the sizing equipment 102, or conveyed to any suitable equipment for reducing the size of the oversized feed. In the present invention, the phrase "dry tar sand" means, under atmospheric conditions, a friable, non-sticky, easily handled, substantially free flowing material.

Tar sand is fed through pressure feeder rotary valves 104A which are circumferentially positioned adjacent and around the upper end of the fluidized bed reactor 104, which is described in detail greater in FIG. 2. The rotary feeders 104A are positioned at an angle of between 20 and 60 degrees relative to the vertical reactor axis in order to "fan feed" the fluidizable sized tar sand into the top of the reactor 104. More uniform dispersion of the tar sand in the fluidized bed reactor can be obtained when three or more rotary feed valves 104A are positioned equidistantly around the circumference of the reactor. Although three feeders 104A are preferred, the size of the reactor and the degree of farming desired will control the number of valve feeders. Thus, there could be 4, 5, 6, 7 or more valve feeders used present invention.

High pressure hydrogen is conveyed through lines 138 to the feeders 104A, at a pressure of between 625 psi and 700 psi, preferably about 635 psi, to assist in injecting, feeding and dispersing the tar sand into reactor 104.

The process performed in fluidized bed reaction 104 involves hydrocracking, which is an endothermic reaction, and hydrogenation, which is an exothermic reaction, which reactions are conducted to favor the production of liquid fuels and minimize the production of gas yields. The reactor operates at temperatures of between 800° F. and 900° F., preferably closer to 800° F. to avoid cracking the large fragments of hydrogenated bitumen in the tar sand.

It is advantageous to conduct the endothermic hydrocracking and exothermic hydrogenating processing of tar sand in reactor 104 in a predominantly hydrogen gas environment. The hydrogen atmosphere in reactor 104 is maintained at about 600 psi by fresh make-up hydrogen conveyed through line 130 from a hydrogen plant and a hydrogen recycle stream 129 which contains cleaned-up hydrogen. The volume of recycle hydrogen to fresh make-up hydrogen is preferably at least about 26 to 1.

Advantageously all the high pressure hydrogen for the process of the present invention, for reaction in reactor 104 and the various heat exchange operations, is provided by the steam powered compressor 132. Compressor 132 receives fresh make-up hydrogen which is conveyed through line 130 and recycle hydrogen which is conveyed through lines 129, 140, 142, 144 and 131. Compressor 132 is powered by steam conveyed through line 162 from direct fired heater 135.

Reactor 104 operates in a highly agitated fashion insuring almost instant and complete reaction between the bitumen components and hydrogen. The residence or retention time of the tar sand in reactor 104 is about 15 minutes, but could be between 10 and 20 minutes, depending on the throughput and efficiency of the reactor process. The pressure drop from the bottom to the top of the reactor 104 is about 35 psi.

Overhead products from reactor 104 are discharged from reactor 104 through cyclone separators 104C, while solids are discharged through separator section 104B located at the lower end of reactor 104. The cyclones separators 104C discharge an overhead stream, e.g., gas and vapor reaction components, off-gas and product, through their upper ends into line 110, while separated solids are discharged through the lower ends of the dip legs. The cyclone separators 104C extend about 20 feet down into the reactor 104 and establish the bed height in the reactor 104.

The hot spent tar sand is continuously discharged at a pressure of about 635 psi and a temperature of about 800° F. through lock hopper valving arrangement 104B in the lower end of reactor 104 into line 105 which conveys the discharged material to spent sand heat exchangers 106 and 108.

The reactor overhead stream from the cyclone separators 104C is discharged into line 110, at a temperature of about 800° F. and a pressure of about 600 psi. The overhead stream discharged from the reactor 104 still contains dust and dry waste particles, and is first conveyed through line 110 to cyclone separator 111 where solids are separated and removed through line 150. The gaseous effluent from separator 111 is conveyed through line 112 to an electrostatic precipitator 113 for the final cleanup. The cleaned overhead stream from precipitator 113 is removed and conveyed through line 114, and separated solids are discharged through line 151. Cyclone separator 111 and electrostatic precipitator 113 are of conventional design and one of ordinary skill in the art practicing the present invention can select suitable devices for performing the described operation.

The cleaned stream from the precipitator 113, product, vaporous components, and off gas, are conveyed to in-and-out heat exchanger 115 through line 114. In the in-and-out exchanger 115 the cleaned stream from line 114 is brought into indirect heat exchange relationship with hydrogen being conveyed through line 133, from compressor 132, i.e., recycle and fresh make-up hydrogen, whereby heat is transferred from the cleaned stream to the hydrogen in line 133 prior to the hydrogen stream entering the fired heater 104. The cooled and cleaned stream, products, vaporous components, off-gases, from heat exchanger 115 is discharged into line 116 while hydrogen is discharged into line 134 which conveys the hydrogen to the direct fired heater 134.

The cooled stream being conveyed through line 116 is introduced into condenser 117 and is discharged at a temperature of about 100° F. into line 118. The vapor and gas stream from the condenser is conveyed through line 118 at a temperature of 100° F. and is introduced into separator 119 where vapors and liquid are separated and discharged.

Since the gas stream has been cooled down to about 100° F. and is still at a pressure of 480 psi, all carbon compounds $C_3$ and above have been condensed are removed from the separator 119 through flow line 155 to storage. Sour water from the separator is discharged through flow line 154. The crude oil product stream in line 155 is a mixture of naphtha and gas oils having an A.P.I. of approximately 33.5 and is a light sweet crude. The gas stream in line 120 is conveyed to a scrubbing system, e.g., at least one amine absorption column 121 where sulfur components, e.g., hydrogen sulfide and sulfur dioxide gases, are absorbed and discharged through line 122 and conveyed to a suitable sulfur recovery plant. The amine absorption system 121 is described in greater detail in FIG. 5.

The only gases not absorbed and removed in absorption system 121 are unreacted recycle hydrogen and $C_1$+$C_2$ hydrocarbons which are conveyed through line 129 to heat exchangers 106 so that the spent tar sand is cooled and the recycle hydrogen and $C_1$+$C_2$ hydrocarbons is heated and discharged into line 140. The $C_1$ and $C_2$ hydrocarbons in line 129 will not be absorbed nor condensed but will be recycled with the unreacted hydrogen after processing in units 141, 143 and 145 discussed hereinafter. The $C_1$ and $C_2$ hydrocarbons will reach equilibrium within the reactor 104 at about 2% and will then add to the production of crude oil per ton of tar sand. A small offset will be the increase in the recycle stream.

As discussed above, the spent sand from the reactor 104 is discharged into a succession of heat exchangers 106 and 108. The first heat exchanger 106 cools the sand from 792° F. to 400° F. using cool recycle hydrogen being conveyed through line 129. The cooled spent sand is conveyed in line 107 from heat exchanger 106 and introduced into a second heat exchanger 108 so that the sand is cooled by cold air introduced through line 180 from blower 181 and through line 182, before discharging. The air heated by the spent sand is discharged into line 183 which conveys the heated air to fired heater 135 for combustion therein. Although two heat exchangers are shown, the invention contemplates using more if necessary.

The heated and partial recycle hydrogen stream conveyed through line 140 is introduced into cyclone 141, discharged into line 142 which conveys the stream to precipitator 143, and then through line 144 for introduction into exchanger 145.

Fluidized Bed Reactor

FIG. 2 schematically shows the pressurized, continuously operating fluid bed reactor 204 in accordance with the present invention. Sized and screened tar sand or shale are conveyed through lines 203 and fed through pressure feeder rotary valves 204A into the top of the reactor 204. A portion of the gases processed in compressor 132 (FIG. 1), and heated in fired heater 135 (FIG. 1) are conveyed by line 236 and introduced into fluidized bed reactor 204 in an upward direction to fluidize the bed of the reactor 204. Another portion of the hydrogen gas from line 133 is conveyed through line 237 to tar sand feed valves 204A through lines 238. Another portion of the hydrogen gas feed from line 237 is diverted through lines 239 and injected into the separator section 204B, at the bottom end of reactor 204. Hydrogen conveyed in lines 239 is injected into the separator section 204B of reactor 204 through injectors which are located at the ends of flow lines 239 (not shown) and aid in heat retention in the reactor system and spent sand discharge through line 205.

High temperature and high pressure hydrogen (make-up and recycle) after passing through the direct fired heater 135, is introduced into reactor 204 from line 236. Reaction products and unreacted hydrogen exit the reactor through internal cyclones 204C ensuring even flow out of the reactor. Although two cyclone separators are shown, the invention contemplates using as many as necessary to provide even flow of product gases from reactor 204 and bed height maintenance. The hot reactor effluent stream in line 210 is then conveyed to physical and chemical units, described in FIG. 1 for cleanup heat recovery and product separation.

Direct Fired Heater

Figure 3:
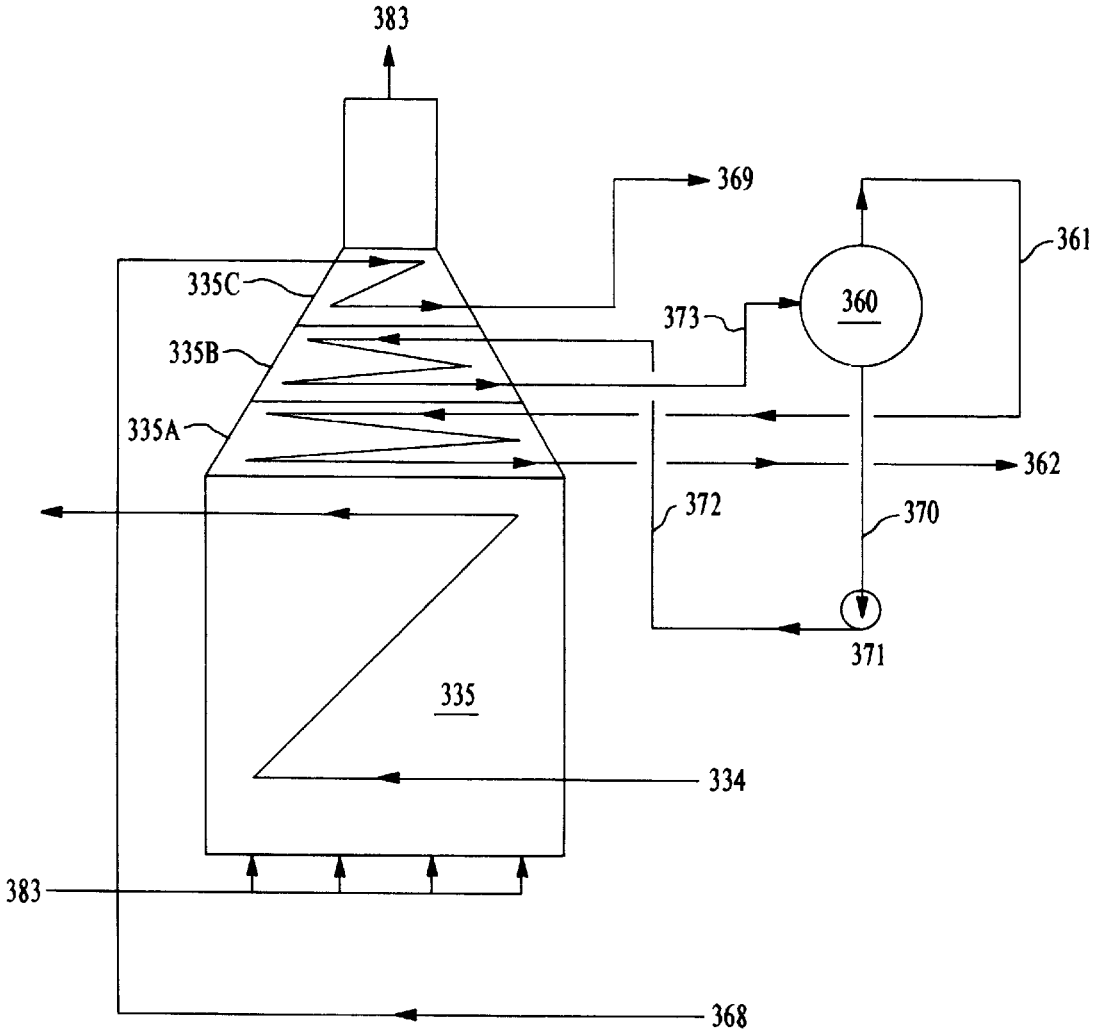
FIG. 3 shows a stand-alone fired heater used in the process according to the present invention.

As discussed above with reference to FIG. 1, a portion of the fresh make-up and cleaned recycle hydrogen from the compressor is conveyed to a direct fired heater. FIG. 3 schematically shows a fired heater 335 (135) that is designed to balance out the total energy required to operate the reactor system. Preheated air conveyed through feed lines 383 (183) is combusted with fuel in the radiant section of fired heater 335 (135) and elevates the temperature of the recycle and make-up hydrogen that is conveyed through line 334 (134). The fuel that is combusted is obtained from the $C_3$ fraction, e.g. propane, or natural gas produced or purchased from the described process or other sources. The hydrogen stream in lines 334 (134) has been preheated in the reactor in-out exchanger 115 to approximately 750° F. Since the hydrogen stream is circulated through the radiant section of the heater 335 the temperature of the hydrogen stream is elevated to a temperature of about 1200° F. Circulation of the hydrogen stream through line 133, 134, exchanger 115 and fired heater 335 is maintained by compressor 132 so that the 1200° F. hydrogen stream can be introduced into reactor 104 (FIG. 1) or 204 (FIG. 2).

Waste heat from the radiant section of direct fired heater 335 is recovered in convection section 335A (135A), 335B (135B) and 335C (135C). Steam separated in drum 360 (160) is discharged into line 361 (161) and introduced into convection section 335A (135A) where the steam temperature is raised from about 596° F. to about 800° F. After passing through convection section 335A (135A), the super heated, high pressure steam is conveyed through line 362 (162) to drive the steam turbine 163. Reduced temperature and pressure steam from turbine 163 is conveyed to steam condenser 165 and the condensate recirculated via line 166 and pump 166A The flow from pump 166A is conveyed through line 168 (368) and combined with make-up water from line 167. The water being conveyed in line 268 is introduced into convection section 335C (135C), heated and discharged through line 369 (169) for further processing, e.g., deaeration.

Steam drum 360 (160) separates steam which is conveyed to radiant section 335A (135A) through line 161 to produce superheated steam for the turbine compressor 163.

The steam circulation loop include steam drum 360 (160), line 370 (170), recirculation pump 371 (171) and lines 372–373 (172–173) which conveys boiler water through radiant section 335B (135B) and back into drum 360 (160). Water for the boiler system is provided through feed line 467 (167) which flows into line 468. Line 468 is similar to flow line 168, 368 which communication with line 169 through connection section 335*a* (135*a* ) to discharge.

As discussed above, convection section 335A (135A) super heats steam which is conveyed through line 362 (162) to drive compressor turbine 163, which drives compressor 132. Steam is generated in convection section 335B (135B) and make-up water and turbine condensate for boiler feed water are preheated in convection section 335C (135C).

Compressor System

Figure 4:
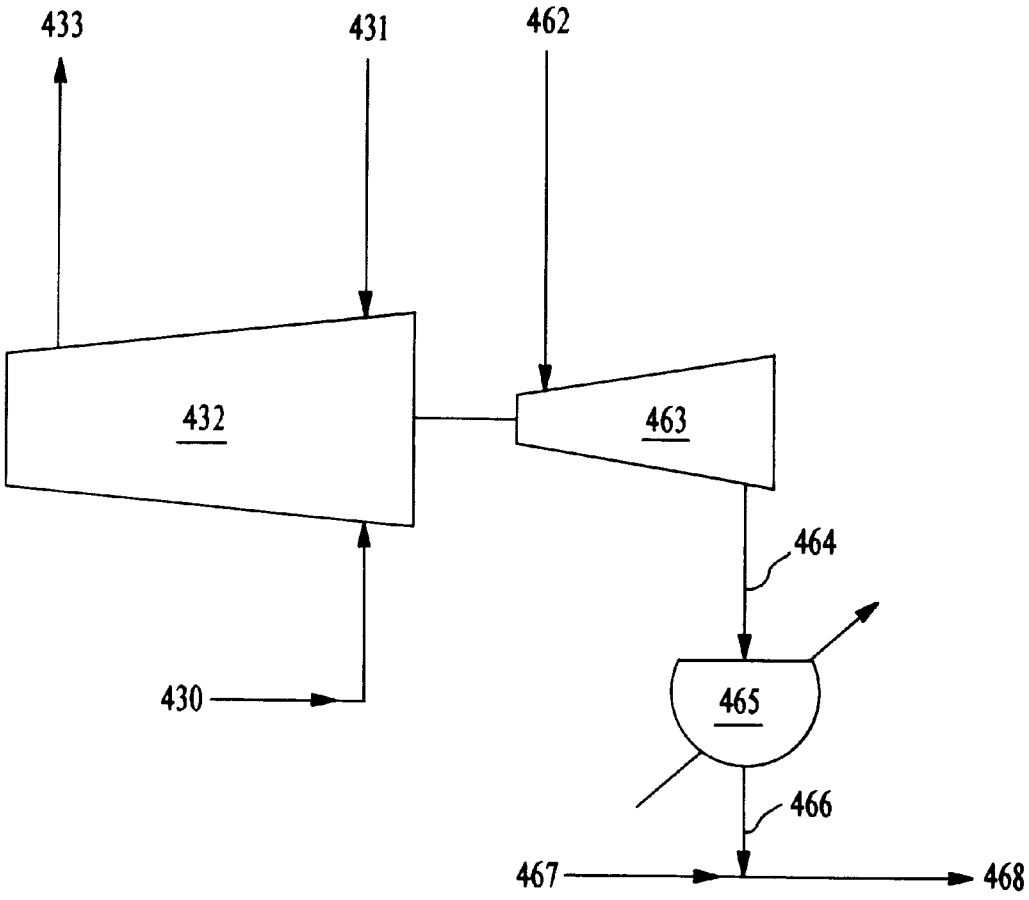
FIG. 4 shows a compressor for supplying the hydrogen for use in the present invention.

FIG. 4, schematically shows a compressor 432 (132) driven by a high pressure steam turbine 463 (163) required to maintain circulation of gases to operate the reactor system 104. Make-up hydrogen 430 (130) and recycle hydrogen 431 (131), at approximately 450 psig and 100° F. are pressurized by the compressor 432 (132) to approximately 670 psig and 122° F. and discharged into line 133 which conveys and introduces the high pressure hydrogen into the in-out exchanger 115 to be further heated by exchange with reactor product gases.

High pressure steam in line 162, 362, at 1500 psig and 800° F. drives the turbine 463 (163). Exhaust steam 464 (164) is condensed in condenser 465 (165), and along with make-up water 467 (167) is fed to the fired heater convection section 135C, 335C for preheating and reuse as boiler feed water make-up.

Product Separation

Figure 5:
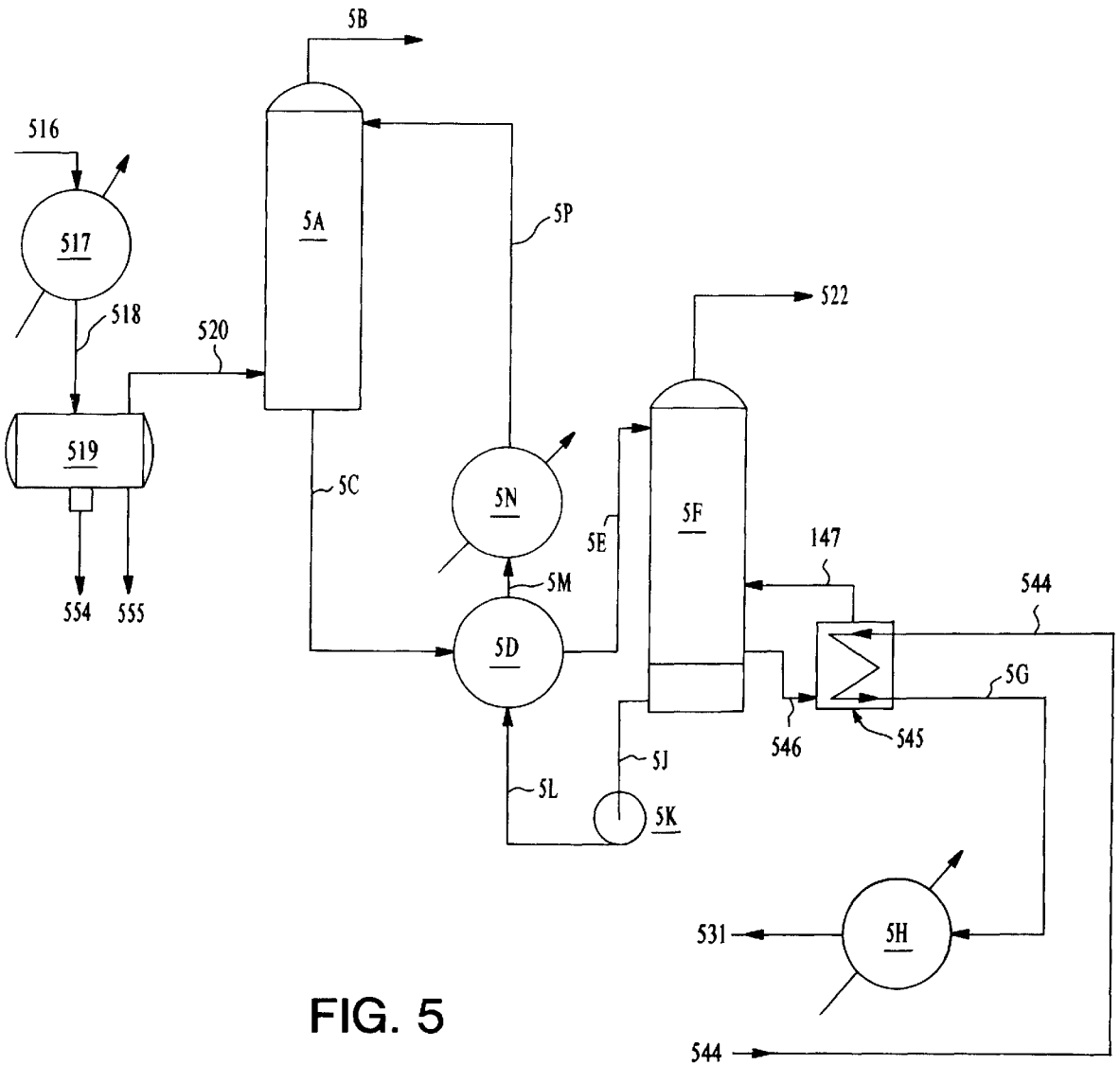
FIG. 5 shows the flow chart of an acid gas recovery system for use in the present invention.

The product separation of FIG. 1, components will be described in greater detail with reference to FIG. 5, which schematically shows the product separation from the circulating gas stream and removal of acid gasses in an amine system. Partially cooled reactor effluent gases 516 (116) from the in-out exchanger 115 are further cooled in product condenser 517 (117) and conveyed through line 518 (118) to separator 519 (119) where condensed liquids are removed as product raw crude 555 (155). Overhead gases are conveyed through line 520 (120) to an amine absorber 5A (121) where acid gasses $H_2S$, $CO_2$ and $SO_2$ are absorbed by a counter current circulating amine solution. The recycle gases 5B flow from the top of the absorber 5A to recycle hydrogen stream 129.

The rich amine solution 5C exits the bottom of the absorber, flows through an amine exchanger 5D where it is heated by exchange with hot stream amine solution 5L and enters the top of an amine stripper 5F. Absorbed acid gases are stripped from the amine solution by the application of heat to the solution in reboiler 545 (145) and are conveyed through flow line 522 (122) from the stripper to sulfur recovery off-site. Hot recycle gases are conveyed through line 544 (144) from the spent sand cooler 145 to provide heat for reboiler 545 (145) and the partially cooled recycled gases 5G are further cooled by cooler 5H and then flow through line 531 (131) to the suction side of compressor 132.

Lean amine solution 5J is circulated by amine circulation pumps 5K through the amine exchanger 5D and amine cooler 5N to the top of the amine absorber 5A to repeat the gas cleanup process.

EXAMPLE 1

Figure 6:
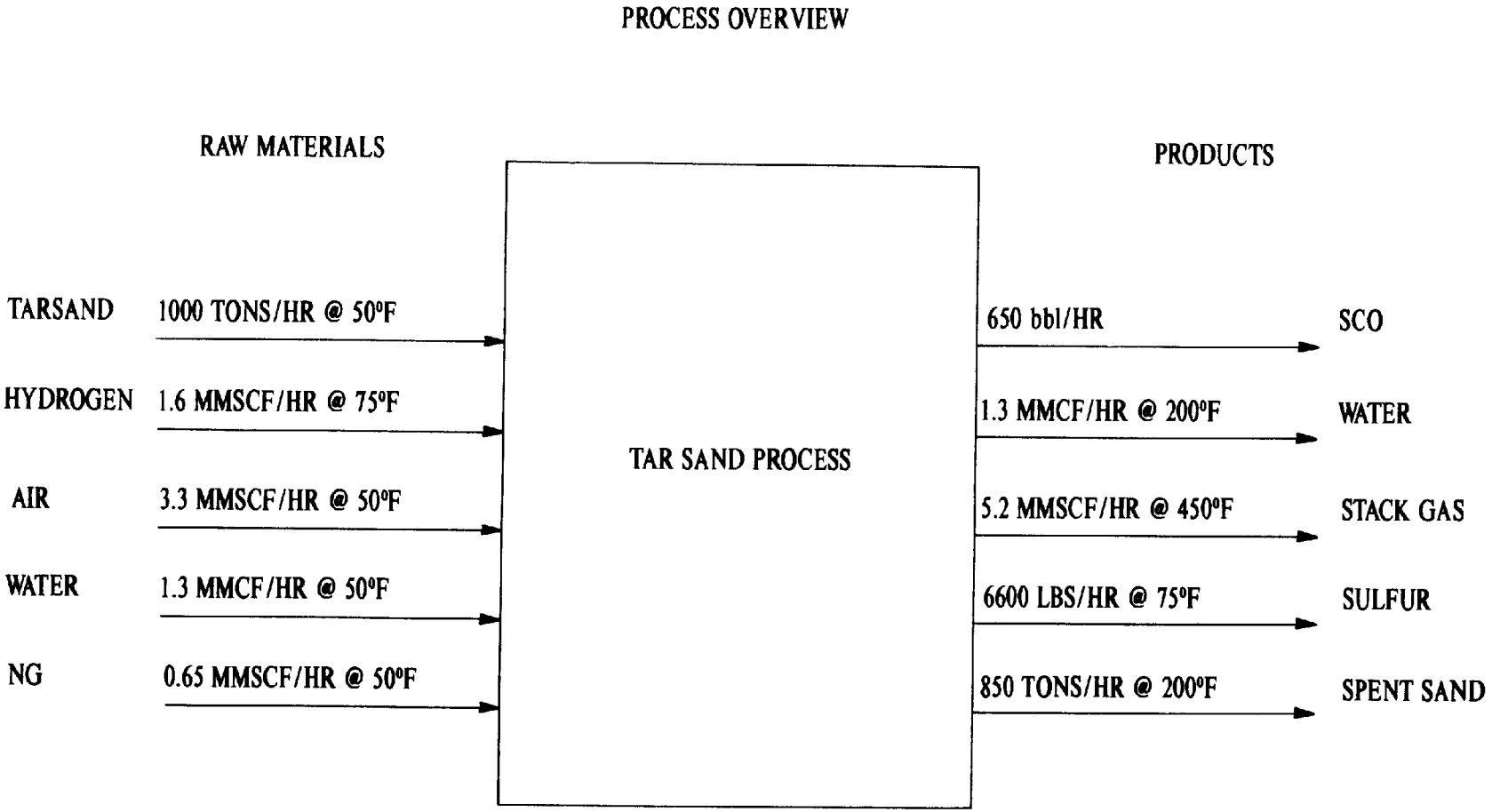
FIG. 6 shows the mass balance for one embodiment of the present invention.

The overall mass balance for the process according to the present invention is shown in FIG. 6, where 1000 tons/br of tar sand at 50° F. are reacted with hydrogen to produce 665 bbl/r of synthetic crude oil. The following Table provides the feed and product values for processing 1000 tons/hr. of tar sand.

| RAW MATERIALS | PRODUCTS |
|---|---|
| 1000 TONS/HR. TAR SAND | 665 BBL/HR SCO |
| 1.6 MMSCF/HR HYDROGEN | 5.2 MMSCF/HR STACK GAS |
| 3.3 MMSCF/HR AIR | 6600 LBS/HR SULFUR |
| 0.5 MMSCF/HR NATURAL GAS | 850 TONS/HR SPENT SAND |

REACTOR DIMENSIONS AND MASS AND ENERGY BALANCES

| | |
|---|---|
| REACTOR 104 | |
| Column Diameter | 20.00 ft |
| Cross Section Area | 34.16 $ft^2$ |
| Void Fraction | 0.85 (At Fluidization) |
| Cross Section of Sand | 47.12 $ft^2$ |
| Cross Section of Gas | 267.04 $ft^2$ |
| Reactor Volume | 27394.26 $ft^3$ |
| Bed Diameter | 20.00 ft |
| Bed Height | 87.20 ft |
| Time-Space Constant | 0.25 hr |
| Pressure Drop | 35.00 psi |
| TAR SAND FEED | |
| Sand Flow Rate | 1000.00 tons/hr |
| Density of sand | 21.68 lbs./$ft^3$ |

-continued

| | |
|---|---|
| Volumetric sand flow | 16436.55 $ft^3$/hr |
| Sand Velocity | 5.81 ft/minute |
| Hold-up | 15.00 minutes |
| HYDROGEN | |
| Hydrogen Flow Rate | 238661.44 lbs/hr (45226343 SCF/hr) |
| Cp of $H_2$ | 3.50 btu/lb-° F. (@ 900° F.) |
| Hydrogen Recycle Ratio | 26.52 |
| Hydrogen Flow Rate | 45.28 SCF/hr |
| Hydrogen Velocity | 3.02 ft/s |
| OFF GAS | |
| Gas Production | 0.40 MMSCF/hr |
| MW | 30.30 g/mole |
| Cp of flue gas | 0.55 btu/lb-° F. |
| OFF GAS COMPOSITION | |
| CO | 0.30% |
| $CO_2$ | 0.20% |
| $H_2S$ | 31.00% |
| $NH_3$ | 2.50% |
| $C_3$ | 66.00% |
| ENERGY BALANCE OVER-ALL CONSIDERATIONS | |
| Heat of Reaction | 75.00 btu/lb. Bitumen |
| Cp Sand | 0.19 btu/ton-° F. |
| Cp Bitumen | 0.34 btu/lb-° F. |
| Cp Tarsand (sand + Bitumen) | 426.70 btu/ton-° F. |
| Sand Feed Temperature | 50.00° F. |
| Sand temperature at reactor inlet | 50.00° F. |
| Reaction temperature | 800.00° F. |
| Sand Feed | 1,000.00 tons/hr |
| TAR SAND REACTOR REACTOR CONDITIONS | |
| Heat required in reactor | 356.03 MMbtu/hr |
| Heat generated in Reactor | 22.50 MMbtu/hr |
| Additional Heat Required | 335.24 MMbtu/hr |
| Minimum $H_2$ for reaction | 9000.00 lbs./hr (1.71 MMSCF/hr) |
| Additional $H_2$ Supplied | 229736.15 lbs./hr (43.53 MMSCF/hr) |
| Total $H_2$ Supplied | 238736.15 lbs./hr (45.24 MMSCF/hr) |
| $C_1$–$C_2$ Flow within $H_2$ Stream (at equilibrium-2%) | 4594.72 lbs/hr (0.08 MMSCF/hr) |
| Entering $H_2$ Temperature | 1200.00° F. |
| Cp $H_2$ | 3.50 btu/lb-° F. |
| Heat Supplied by $C_1$–$C_2$ | 1.01 MMbtu/hr |
| Heat Supplied by $H_2$ | 334.23 MMbtu/hr |
| $H_2$ Recycle ratio | 26.53 |
| REACTOR BOTTOMS COOLER: Assures Efficient Removal of Exiting Solids | |
| Cold Hydrogen Cooler Stream | 1,148.68 lbs./hr (0.22 MMSCF/hr) |
| Heat Removed | 2.73 MMbtu/hr |
| Entering Hydrogen Temperature | 121.64° F. |
| Exiting Sand Temperature | 791.60° F. |
| SAND COOLER SAND | |
| Sand Flow Rate | 850.00 tons/hr |
| Temperature of Entering Sand | 791.60° F. |
| Temperature of Spent Sand | 180.00° F. |
| Cp Sand | 0.19 btu/lb-° F. |
| Heat Removed | 198.59 MMbtu/hr |
| HYDROGEN COOLANT FLOW | |
| Hydrogen Flow | 238736.15 lbs/hr (45.24 MMSCF/hr) |
| Heat to Be Removed | 182.96 MMb/hr |
| Entering Hydrogen Temperature | 100.00° F. |
| Exiting Hydrogen Temperature | 318.96° F. |

-continued

| | |
|---|---|
| AIR COOLANT | |
| Air Required for Combustion | 250000.00 lbs/hr (3.27 MMSCF/hr) |
| Cp Air | 0.25 btu/lb-° F. |
| Entering Air Temperature | 50.00° F. |
| Exiting Air Temperature | 300.00° F. |
| Heat Removed | 15.63 MMbtu/hr |
| AMINE REBOILER | |
| HYDROGEN SUPPLY | |
| Entering Hydrogen Temperature | 318.96° F. |
| Exiting Hydrogen Temperature | 100.00° F. |
| AMINE BOIL-OFF | |
| Heat Available to the system | 182.96 MMbtu/hr |
| IN-OUT HEAT EXCHANGER | |
| HYDROGEN TO BE HEATED | |
| Hydrogen Flow | 238736.15 lbs/hr (45.24 MMSCF/hr) |
| Inlet $H_2$ Temperature | 121.64° F. |
| Exiting $H_2$ Temperature | 750.00° F. |
| Total Heat Required | 525.05 MMbtu/hr |
| OFF GAS HEAT SUPPLY | |
| Off Gas flow rate | 31978.89 lbs/hr 0.40 MMSCF/hr |
| Condensables in vapor phase | 214941.75 lbs/hr |
| MW | 30.30 lb/lb-mole |
| Cp Vapor | 0.55 btu/lb-° F. |
| Cp Liquid | 0.45 btu/lb-° F. |
| Cp Non-Condensaes | 3.00 btu/lb-° F. |
| Heat of Vaporization | 65 .00 btu/lb |
| Hydrogen Recycle Flow in Stream | 229736.15 hrs/hr (*43.53 MMSCF/hr) |
| Inlet Temperature | 800.00° F. |
| Exit Temperature | 350.00° F. |
| PRODUCT CONDENSER/COOLER | PRODUCT SIDE |
| Entering Temperature | 350.00° F. |
| Exiting Temperature | 100.00° F. |
| Condensate | 24941.75 lbs/hr (665.29 bbl/hr) |
| Heat Removal $H_2$ | 201.02 MMbtu/hr |
| Off Gas | 4.40 MMbtu/hr |
| Condensate | 38.15 MMbtu/hr |
| Total | 243.57 MMbtu/hr |
| COOLER REQUIREMENT | 243.57 MMbtu/hr |
| COMPRESSOR | HYDROGEN SIDE |
| Flow Rate | 755412.69 SCF/min (45.32 MMSCF/hr) |
| Pressure Out | 670.00 psi |
| Pressure In | 450.00 psi |
| DP | 220.00 psi |
| gamma (Cp/Cv) | 1.40 |
| # Stages | 3 |
| Temperature Inlet | 100.00° F. |
| Mechanic Efficiency | 0.80 *100% |
| Pb/Pa | 1.14 |
| Power Requirement per Stage | 6366.67 hp |
| Total Power Required | 19100.00 hp |
| Outlet Temperature | 121.64° F. |
| STEAM SUPPLY | |
| Pressure | 1500.00 psi |
| Temperature | 800.00° F. |
| Degree Superheat | 200.00° F. |
| Saturation Temperature | 596.20° F. |
| Steam Heat Vue | 1364.00 btu/lb |
| Flow Rate | 10894.28 lbs/hr |
| FIRED HEATER | PRODUCTS TO BE HEATED |
| Hydrogen Flowrate | 238736.15 lbs/hr (45.24 MMSCF/hr) |
| Hydrogen Temperature | 750.00° F. |
| Water Flow Rate | 10894.28 lbs/hr |

-continued

| | |
|---|---|
| Water Temperature | 75.00° F. |
| Heat Duty | 517.83 MMbtu/hr |
| $C_3$'S (FUEL PRODUCED BY THE PROCESS) | |
| Flow Rate | 4263.85 lbs/hr (0.04 MMSCF/hr) |
| Heat of Combustion | 20000.00 btu/lb |
| Cp | 0.60 btu/lb-° F. |
| Temperature in | 75.00° F. |
| Heat Supplied (After temperature correction) | 79.84 MMbtu/hr |
| MAKE-UP METHANE | |
| Combustion Temperature | 2200.00° F. |
| Heat Remaining to be supplied by Methane | 437.99 MMbtu/hr |
| Flow Rate | 21653.89 lbs/hr (0.51 MMSCF/hr) |
| Heat of Combustion (After temperature correction) | 20227.00 btu/lb |
| Temperature in | 75.00° F. |
| COMBUSTION AIR | |
| Air Required for Combustion | 200000.00 lbs/hr (2.61 MMSCF/hr) |
| Air Supplied 25% Excess | 250000.00 lbs/hr (3.27 MMSCF/hr) |
| COMPRESSOR SUCTION COOLER (5H) | |
| OUTFLOWS | |
| Hydrogen | |
| Flowrate | 200000.00 lbs/hr |
| Temperature | 100.00° F. |
| Required Coolant Supply | 22.42 MMbtu/hr |
| MATERIAL BALANCE | |
| TAR SAND REACTOR (104) | |
| IN FLOWS | |
| Sand | |
| Flowrate | 1000.00 tons/hr |
| Temperature | 50.00° F. |
| Pressure | 14.70 psia (Force Fed) |
| Hydrogen | |
| Flowrate | 45.23 MMSCF/hr |
| Temperature | 1200.00° F. |
| Pressure | 635.00 psi |
| $C_{1-C2}$s | |
| Flowrate | 0.08 MMSCF/hr |
| Temperature | 1200.00° F. |
| Pressure | 635.00 psi |
| OUT FLOWS | |
| Sand | |
| Flowrate | 850.00 tons/hr |
| Temperature | 190.00° F. |
| Pressure | 600.00 psi |
| Off Gas | |
| Flowrate | 43.92 MMSCF/hr |
| Temperature | 800.00° F. |
| Pressure | 600.00 psi |
| Composition | wt % |
| $H_2$ | 81.98 |
| CO | 0.05 |
| $CO_2$ | 0.04 |
| $H_2S$ | 5.60 |
| $NH_3$ | 0.45 |
| $C_3$ | 11.92 |

-continued

| | | |
|---|---|---|
| Product | | |
| | Flowrate (Vapor Phase) | 214937.52 lbs./hr |
| | Temperature | 800.00° F. |
| | Pressure | 600.00 psi |
| SAND COOLER (106, 108) | | IN FLOWS |
| Sand | | |
| | Flowrate | 850.00 tons/hr |
| | Temperature | 791.92° F. |
| | Pressure | 600.00 psi |
| Hydrogen | | |
| | Flowrate | 45.23 MMSCF/hr |
| | Temperature | 100.00° F. |
| | Pressure | 500.00 psi |
| Air | | |
| | Flowrate | 3.27 MMSCF/hr |
| | Temperature | 50.00° F. |
| | Pressure | 30.00 psi |
| OUT FLOWS | | |
| Sand | | |
| | Flowrate | 850.00 tons/hr |
| | Temperature | 200.00° F. |
| | Pressure | 480.00 psi |
| Hydrogen | | |
| | Flowrate | 45.23 MMSCF/hr |
| | Temperature | 313.94° F. |
| | Pressure | 480.00 psi |
| Air | | |
| | Flowrate | 3.27 MMSCF/hr |
| | Temperature | 300.00° F. |
| | Pressure | 20.00 psi |
| IN-OUT HEAT EXCHANGER (115) | | IN FLOWS |
| Hydrogen | | |
| | Flowrate | 45.23 MMSCF/hr |
| | Temperature | 147.60° F. |
| | Pressure | 670.00 psi |
| Off Gas | | |
| | Flowrate | 43.92 MMSCF/hr |
| | Temperature | 800.00° F. |
| | Pressure | 600.00 psi |
| | Composition | wt % |
| | $H_2$ | 81.98 |
| | CO | 0.05 |
| | $CO_2$ | 0.04 |
| | $H_2S$ | 5.60 |
| | $NH_3$ | 0.45 |
| | $C_3$ | 11.92 |
| Product | | |
| | Flowrate (Vapor Phase) | 214937.52 lbs./hr |
| | Temperature | 800.00° F. |
| | Pressure | 600.00 psi |
| OUT FLOWS | | |
| Hydrogen | Flowrate | 45.23 MMSCF/hr |
| | Temperature | 750.00° F. |
| | Pressure | 650.00 psi |
| Off Gas | Flowrate | 43.92 MMSCF/hr |
| | Temperature | 368.63° F. |
| | Pressure | 580.00 psi |
| Off Gas Composition as Above | | |
| Product | | |
| | Flowrate (Vapor Phase) | 214937.52 lbs./hr |
| | Temperature | 368.63° F. |
| | Pressure | 580.00 psi |

-continued

| | | |
|---|---|---|
| PRODUCT CONDENSER/ COOLER (117) | | IN FLOWS |
| Off Gas | | |
| | Flowrate | 43.92 MMSCF/hr |
| | Temperature | 368.63° F. |
| | Pressure | 580.00 psi |
| Off Gas Composition as Above | | |
| Product | | |
| | Flowrate (Vapor Phase) | 214937.52 lbs./hr |
| | Temperature | 368.63° F. |
| | Pressure | 550.00 psi |
| OUT FLOWS | | |
| Off Gas | | |
| | Flowrate | 43.92 MMSCF/hr |
| | Temperature | 100.00° F. |
| | Pressure | 540.00 psi |
| Off Gas Composition as Above | | |
| Product | | |
| | Flowrate (as condensate) | 214937.52 lbs./hr |
| | Temperature | 100.00° F. |
| | Pressure | 540.00 psi |
| AMINE SYSTEM (121, FIG. 5) | | IN FLOWS |
| Hydrogen | | |
| | Flowrate | 45.23 MMSCF/hr |
| | Temperature | 318.00° F. |
| | Pressure | 470.00 psi |
| OUT FLOWS | | |
| Hydrogen | | |
| | Flowrate | 45.23 MMSCF/hr |
| | Temperature | 100.00° F. |
| | Pressure | 450.00 psi |

EXAMPLE 2

Figures 2, 7:
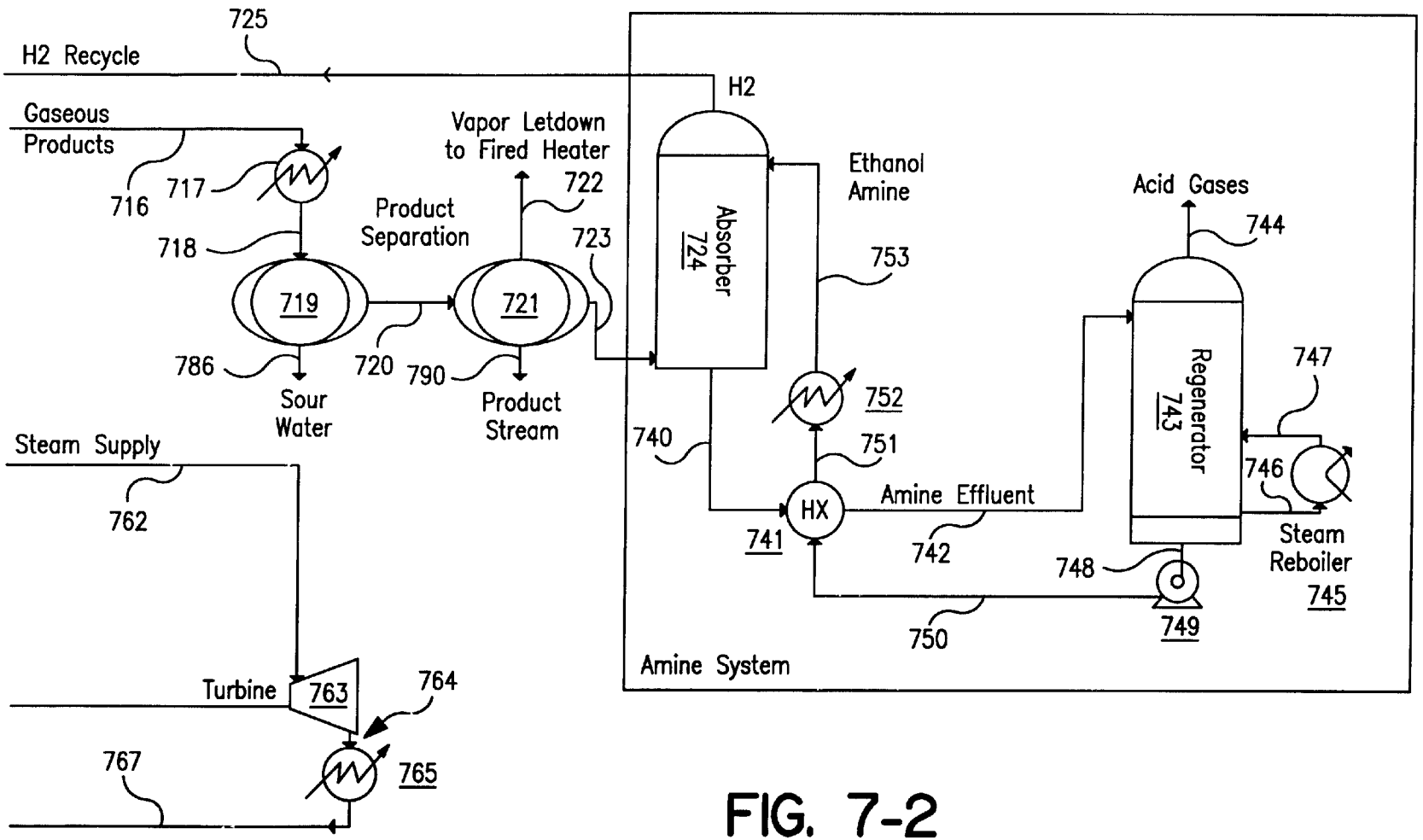
FIG. 7 shows a flow diagram of a second embodiment according to the present invention.

FIG. 7 shows another embodiment of the present invention. In this embodiment, a tar sand feed is converted into a synthetic crude oil. Run of mine tar sand from trucks is dumped into receiving, screening, and sizing equipment 702 for classifying tar sand at ambient temperature. The tar sand comprises bitumen and sand. The tar sand is crushed into relatively large fluidizable pieces that are capable of passing through a one inch mesh, or that are about one inch or less in size. In this embodiment, crushing the tar sand into fines or pieces less than sand size is preferably avoided to facilitate fines removal from the product stream. Limiting the amount of crushing can also reduce heat generation that can adversely affect tar sand processing. Limiting crushing can also help to preserve a water film that surrounds tar sand pieces. Tar sand pieces typically comprise an agglomeration of sand particles, each sand particle surrounded by a film of water and an outer layer of bitumen. On contacting a hot fluidizing flow of hydrogen during later reaction steps, the water film can rapidly evaporate assisting the tar sand pieces to disintegrate into a finely fluidized dispersion of sand particles and bitumen in hydrogen.

Figure 8:
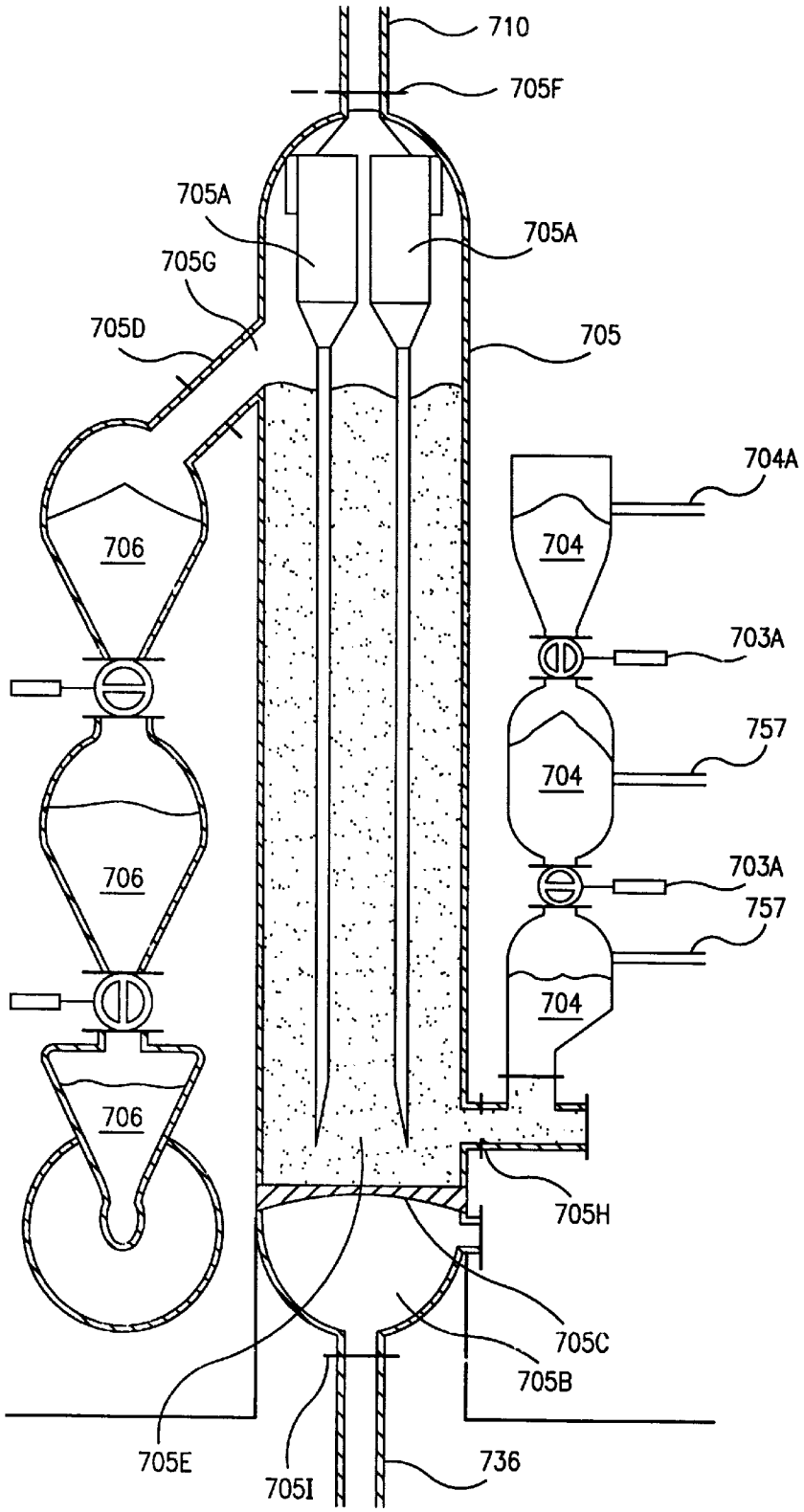
FIG. 8 shows a fluidized bed reactor and lock hoppers of the second embodiment according to the present invention.

The crushed tar sand is conveyed through conduit 703 to feed lock hoppers 704 as the feed for fluidized bed rector 705. The feed flow through conduit 703 and between feed lock hoppers 704 is controlled by pressure feeder rotary valves ("rotary valves") 703A. The bitumen in the tar sand can contain heavy metals, such as nickel, which may catalytically promote endothermic and exothermic reactions in reactor 705. However supplemental catalyst such as, for example, nickel, cobalt, molybdenum, and vanadium can be added through catalyst feed conduit 704A to one of the feed lock hoppers 704 to assist catalysis provided by the heavy metals in the mined tar sand or shale. The reactor 705 and related equipment are shown in more detail in FIG. 8.

Recycle hydrogen in conduit 725 and fresh make-up hydrogen in conduit 725A are conveyed to compressor 732. A first mixture of recycle hydrogen and makeup hydrogen exits compressor 732 in line 733, is cooled by heat exchanger 754, passes through line 757 to feed lock hoppers 704. This cooled first hydrogen mixture helps to prevent the tar sand from gumming by keeping the tar sand cool and forces the crushed tar sand into the reactor 705 which operates at a pressure of about 600 psi. Preferably, the first hydrogen mixture reaches the lock hoppers 704 at a temperature of about 100° F. or less, and maintains the tar sand at a temperature of about 100° F. or less. The tar sand is fed from feed lock hoppers 704 through conduit 704B and into reactor 705 through a feed inlet 705H, assisted by the first hydrogen mixture at 670 psi pressure in line 757. There are three feed lock hoppers in this embodiment, but the number may vary in other embodiments. The tar sand can be fed into the rector approximately horizontally, near the bottom of the reactor, and just above ceramic grid 705C. Equipment for treating mined tar sand or shale feed material and for feeding the material into reactor, such as the equipment described above, can be referred to as a feed introducing system. Equipment for feeding tar sand or shale feed material into the reactor, such as the feed lock hoppers 704, conduit 703 and rotary valves 703A, can be referred to as a feeder device.

On entering the reactor 705, the tar sand is contacted and heated by a second hydrogen mixture. The second hydrogen mixture flows from fired heater 735 and into a gas inlet 705I at the bottom of the reactor 705B through ceramic lined conduit line 736 at a temperature of about 1500° F. and about 635 psi pressure. The second hydrogen mixture passes through a slotted fire brick or ceramic grid 705C before contacting the entering tar sand. The flow rate and velocity of the second hydrogen mixture are sufficient to fluidize the tar sand and to beat the tar sand to a desired reaction temperature. The heated tar sand and the second hydrogen mixture react in the reactor 705 in a fluidized bed 705E at the desired reaction temperature of about 900° F. to about 1000° F., and at a pressure of about 600 psi. The second hydrogen mixture flow rate typically exceeds the minimum needed for complete tar sand reaction wit hydrogen by a factor of about 15 to about 26, and preferably by a factor of about 21. Adjustment of the second hydrogen mixture flow rate may require adjustment of other reaction parameters to maintain the fluidized bed 705E at desired pressures and temperatures. The tar sand reacts with the hydrogen mixture in the fluidized bed 705E by endothermic hydrocracking and exothermic hydrogenating reactions. Reaction products include substantially sulfur-free hydrocarbon that are condensable into hydrocarbon liquids at standard temperature and pressure.

Reaction products including synthetic crude oil and unreacted hydrogen mixture exit the reactor 705 through a product stream outlet 705F as an overhead or product stream through cyclone separators 705A and into exit conduit line 710. Solids entrained in the overhead product stream, such as sand particles and fines, are trapped by the cyclone separators 705A and are deposited near the ceramic screen 705C at the bottom of the reactor 705B, where they are again entrained in the fluidized bed 705E. Eventually, the spent sand and solids exit the reactor 705 through a conduit line 705D. The overhead stream flows through a hydrogen recycling system wherein hydrogen is removed from the remainder of the overhead stream, treated, and returned to the reactor.

It is advantageous to conduct the endothermic hydrocracking and exothermic hydrogenation reactions in a predominantly hydrogen gas environment. The first and second hydrogen mixtures are mixtures of fresh make-up hydrogen and recycle hydrogen which are fed to a compressor 732 via conduit lines 725A and 725 respectively. The recycle hydrogen contains hydrogen and up to 5 mole percent of combined methane and ethane. The amount of combined methane and ethane in the recycle hydrogen is maintained by a purge in a hydrogen recycle system connected to the reactor 705. The volume of recycle hydrogen to fresh make-up hydrogen is preferably about 21:1, but can vary from about 15:1 to about 26:1.

The reactor 705 is operated so as to highly agitate the reactants and ensure rapid and complete reaction between the bitumen components and hydrogen in the reactor 705. The residence or reaction time of the tar sand in reactor 705 is about 10 minutes, but can be between 5 and 20 minutes, depending on the throughput and efficiency of the reactor process. The pressure drop from the bottom to the top of the fluidized bed 705E is about 35 psi.

Spent sand, at a temperature of about 950° F., overflows from reactor 705 into conduit line 705D through a spent solids outlet 705G. The height of the conduit line 705D may establish the maximum height of the fluidized bed 705E. The sand then flows through spent sand lock hoppers 706, through conduit line 707 and into rotary coolers 708 which cool the sand from a temperature of 950° F. to about 665° F. The cooled sand can be discharged and used, for example, for land reclamation.

The rotary coolers 708 can use ambient air fed through air intake 778 to cool the spent sand. The air exits the rotary coolers 708 through line 779 at a temperature of about 625° F. and passes through a cyclone 780 to remove entrained fines. The fines are discharged through conduit line 785. The cooling air is preheated by the spent sand, then passes to the fired heater 735 via blower 782 and conduit lines 781 and 783 where the air is used as preheated combustion air.

The number of feed lock hoppers 704 and spent sand lock hoppers 706 is controlled by the size of the reactor, thus more or less than the three feed lock hoppers 704 and more or less than three spent sand lock hoppers can be used in the present invention.

The reactor overhead stream from the cyclone separator 705A is discharged into line 710, and then to hot gas clean-up 711. The overhead stream in line 710 exits the reactor 705 at about 950° F. and enters the hot gas clean-up 711. Ceramic bag collectors or filters in the hot gas clean-up 711 remove and collect fines remaining in the overhead stream. The filters are periodically pulsated by a back flow of a 650 psi, 875° F. hydrogen mixture taken from in-out heat exchanger 715 via conduit line 734A. Collected fine and solids are removed from the bottom of the hot gas clean-up 711 and are collected in hot gas clean-up lock hoppers 712. The fines can be combined with spent sand and used for land reclamation. The disposal of the dry sand and fines resulting from this invention is environmentally preferable to existing wet disposal systems.

The substantially solids-free overhead stream flows from the hot gas clean-up through line 713 to the in-out heat exchanger 715. The in-out heat exchanger 715 is an indirect heat exchanger wherein heat is transferred from the overhead stream to a portion of the hydrogen mixture exiting compressor 732 via conduit 733. The heated hydrogen mixture is conveyed via a conduit line 734 to the fired heater 735. The cooled overhead stream exits the in-out heat exchanger 715 through line 716.

The overhead stream in line 716 enters condenser 717 where condensable vapors and gases are condensed. The overhead stream exits the condenser 717 in line 718 at a temperature of about 100° F. and passes to a first separator 719 where sour water is purged from the overhead stream via line 786. The overhead stream, now purged of sour water, passes to a second separator 721 via conduit line 720 where a small vapor letdown stream is separated from the overhead stream and flows through line 722 to fired heater 735. Also, carbon compounds $C_3$ and above are condensed and removed from the separator 721 through flow line 790 as a light substantially sulfur-free synthetic crude oil product stream comprising a mixture of naphtha and gas oils having an A.P.I. gravity of approximately 33.5. The crude oil product stream in conduit line 790 flows to storage and shipping. The remaining fluid in the separator 721, including recycle hydrogen, is at a temperature of about 100° F. and 480 psi pressure and discharges from the separator 721 as a stream in line 723 to a scrubbing system. The scrubbing system typically comprises at least one amine absorption column 724 where sulfur components, for example, hydrogen sulfide and sulfur dioxide gases, are absorbed and discharged through line 744 from regenerator 743. A sulfur recovery system can be used to recover sulfur from the sulfur components.

The absorber 724 can comprise, for example, a counter current circulating ethanol amine solution in intimate contact with the remaining overhead stream. The remaining fluid stream can comprise gases such as, for example, $H_2S$, $CO_2$, $SO_2$, $NH_3$, recycle hydrogen, and $C_1$ and $C_2$ hydrocarbons. $H_2S$, $CO_2$, $SO_2$, and $NH_3$ are removed from the remaining fluid stream by the absorber 724. Remaining hydrogen, $C_1$ and $C_2$ hydrocarbons form the recycle hydrogen mixture and flow through line 725 to compressor 732.

The rich amine solution having absorbed $H_2S$, $CO_2$, $SO_2$ and $NH_3$ is discharged from the absorber 724 through line 740 and flows through an amine heat exchanger 741. In the amine heat exchanger 741 the rich amine solution is heated by exchange with hot amine solution in line 750 which is returning from amine regenerator 743 to the absorber 724. The heated rich amine solution flows through line 742 and enters the top of the amine regenerator 743. Absorbed acid gases are stripped from the rich amine solution by further heating the rich solution using steam from a steam reboiler 745 Heat for the reboiler 745 is supplied by steam from the fired heater 735 steam recovery system.

Lean amine solution is discharged from the regenerator 743 in line 748 and is circulated by an amine circulation pump 749 through amine exchanger 741 and amine cooler 752 to the top of the amine absorber 724.

Recycle hydrogen, and $C_1$ and $C_2$ hydrocarbons flow through line 725 to compressor 732 and are mixed with make up fresh hydrogen in line 725A at a pressure of 450 psi and a temperature of about 100° F. The recycle gas stream is also at a pressure of 450 psi, which is the lowest pressure in the system. The compressor 732 is driven by a high pressure steam turbine 763. High pressure steam supply in line 762 comes from the fired heater steam system at 900 to 1500 psi and a temperature of 800° F., which is super heated by 200° F. in the fired heater 735. Exhaust steam in line 764 is condensed in condenser 765 and along with make up water is fed to the fired heater 735 for preheating and reuse as boiler feed water make up.

The compressor 732 pressurizes the recycle hydrogen mixture and make-up hydrogen from 450 psi to approximately 670 psi and 187° F. and discharge the hydrogen mixture into line 733. A portion of the hydrogen mixture in line 733 is the first hydrogen mixture and is delivered to heat exchanger 754 via line 733A. Another portion of the hydrogen mixture in line 733 is the second hydrogen mixture and is delivered to the in-out heat exchanger 715.

The heat exchanger 754 cools the first hydrogen mixture from about 187° F. to 100° F. A portion of the first hydrogen mixture in line 757 flows into line 756 and to a $C_1$ and $C_2$ hydrocarbon pressure swing adsorption ("PSA") system 755. The PSA system helps to maintain the $C_1$ and $C_2$ hydrocarbon level in the first and the second hydrocarbon mixture at about 2% –3%. $C_1$ and $C_2$ hydrocarbon purged from the first hydrocarbon mixture is discharged through line 758 and combined with the gas in line 22 which is delivered to the fired heater 735. Purified hydrogen produced by the PSA 755 flows through line 756A and back to the suction of compressor 732 via line 725.

The second hydrogen mixture is preheated to 875° F. in the in-out heat exchanger 715 by the overhead stream at 935° F. Preheated air conveyed through feed line 783 is combusted with fuel in the fired heater 735 and elevates the temperature of the second hydrogen mixture that is conveyed through line 734 from in-out heat exchanger 715. The fuel that is combusted is obtained from the natural gas line 759 and purge gas line 722. The hydrogen mixture circulates through the fired heater 735 and exits through line 736. The second hydrogen mixture provides the heat required to maintain reaction in the reactor 705.

Waste heat from the radiant section of direct fired heater 735 is recovered in convection sections 735A, 735B and 735C. Steam and water are discharged from a steam drum 760 into the fired heater 735. Heated steam is returned to the drum via line 773. Steam separated from water in drum 760 is discharged into line 761 and introduced into convection section 735A where the steam temperature is raised from about 596° F. to about 800° F. After passing through convection section 735A, the super heated, high pressure steam is conveyed through line 762 to drive the steam turbine 763. Reduced temperature and pressure steam from turbine 763 is conveyed to steam condenser 765 and the condensate recirculated via line 767. The flow from pump 766A is conveyed through line 767 and combined with make-up water. The water being conveyed in line 767 is introduced into convection section 735C, heated and discharged through line 736 for further processing, such as aeration.

The following table shows material flows and operating conditions an operating reactor system.

| FLUIDIZED BED REACTOR: | | |
|---|---|---|
| Reactor (fluidized bed) Temperature | 950° F. | |
| Reactor (fluidized bed) Pressure | 600 | psi |
| $H_2$ Recycle Ratio | 21.09 | |
| Catalyst Flow Rate into Reactor | 1255.07 | lbs/hr |
| Tar Sand Flow into Reactor | 2520 | tons/hr |
| Tar Sand Feed Inlet Temperature | 50° F. | |
| Hydrogen Mixture Flow Rate into Reactor | 60.4 | MMSCF/hr |
| Hydrogen Mixture Gas Inlet Temperature | 1500° F. | |

-continued

| | | |
|---|---|---|
| ROTARY COOLERS: | | |
| Air Temperature at Intake | 50° F. | |
| Air Temperature (exiting) | 623° F. | |
| Sand Entering Temperature | 950° F. | |
| Sand Exiting Temperature | 665° F. | |
| IN-OUT HEAT EXCHANGER: | | |
| Overhead Stream Entering Volumetric Flow Rate | 58.31 | MMSCF/hr |
| Overhead Stream Entering Temperature | 950° F. | |
| Overhead Stream Exiting Temperature | 516° F. | |
| Hydrogen Mixture Entering Flow Rate | 60.4 | MMSCF/hr |
| Hydrogen Mixture Entering Temperature | 185° F. | |
| Hydrogen Mixture Exiting Temperature | 875° F. | |
| FIRED HEATER: | | |
| Fuel Consumption (natural gas eqivalent) | 1.2 | MMSCF/hr |
| Vapor Let-Down & PSA Off Gas Fuel Supply (natural gas equivalent) | 0.56 | MMSCF/hr |
| Make-up Fuel Supply | 0.64 | MMSCF/hr |
| Combustion Air Entering Flow Rate (@ 65% excess) | 26.59 | MMSCF/hr |
| Steam Production Rate (@ 1500 psi) | 228,996 | lbs/hr |
| Hydrogen Mixture Entering Flow Rate | 60.4 | MMSCF/hr |
| Hydrogen Mixture Entering Temperature | 875° F. | |
| Hydrogen Mixture Exiting Temperature | 1500° F. | |
| COMPRESSOR: | | |
| Power Required From Turbine | 40,148 | h.p. |
| Steam Flow Rate to Turbine | 228,996.1 | lbs/hr |
| Steam Pressure Entering Turbine | 1500 | psi |
| Steam Temperature Entering Turbine (200° F. superheat) | 800° F. | |
| Hydrogen Mixture Entering Flow Rate | 60.7 | MMSCF/hr |
| Hydrogen Mixture Compressor Entering Temperature | 100° F. | |
| Hydrogen Mixture Compressor Entering Pressure | 450 | psi |
| Hydrogen Mixture Compressor Exiting Temperature | 185° F. | |
| Hydrogen Mixture Compressor Exiting Pressure | 670 | psi |
| PRODUCT CONDENSER/SEPARATOR: | | |
| Product Fluid Stream Entering Flow Rate | 58.3 | MMSCF/hr |
| Product Fluid Stream Entering Temperature | 516° F. | |
| Recycle Hydrogen Mixture Exiting Temperature | 100° F. | |
| Synthetic Crude Oil Flow Rate | 1255 | bbl/hr |
| AMINE SYSTEM: | | |
| Amine Recirculation Flow Rate | 50,400 | lbs/hr |
| Ammonia Production | 1478 | lbs/hr |
| Elemental Sulfur Production | 17260 | lbs/hr |

While particular embodiments of the present invention have been illustrated and described herein, the present invention is not limited to such illustrations and descriptions. It is apparent that changes and modifications may be incorporated and embodied as part of the present invention within the scope of the following claims.

We claim:

1. A process for producing oil from a substantially dry oil bearing feed wherein said feed is tar sand or oil shale, comprising the steps of:

a. introducing said feed in a fluidizable form into a fluidized bed reactor;

b. introducing a fluidizing medium into the fluidized bed reactor, said fluidizing medium including at least hydrogen;

c. fluidizing said introduced feed with said fluidizing medium in the reactor to form a fluidized bed;

d. continuously reacting said feed with substantially only hydrogen in the fluidized bed reactor at a temperature of at least 900° F.;

e. continuously discharging a product stream and spent solids from said fluidized bed reactor.

2. The process of claim 1 further comprising the step of reducing the size of said feed to produce a fluidizable feed, prior to the feeding step.

3. The process of claim 2 wherein said feed is tar sand.

4. The process of claim 2 wherein said feed is shale.

5. The process of claim 3 wherein the tar sand is crushed to 1 inch or less size pieces.

6. The process of claim 1 wherein the introducing step a) comprises injecting the feed adjacent a bottom end of the reactor and the discharging step e) comprises discharging said spent solids adjacent a top end of said reactor.

7. The process of claim 3 wherein the fluidizing medium contains substantially only hydrogen and the hydrogen is introduced into the reactor at a rate that exceeds the minimum required for complete tar sand reaction with hydrogen by a factor of between 15 and about 26.

8. The process of claim 7 wherein the fluidized bed a temperature and the fluidizing hydrogen entering the reactor has a temperature, wherein the fluidizing hydrogen temperature is greater than fluidized bed temperature.

9. The process of claim 8 wherein the fluidizing hydrogen temperature on entering the reactor is 1500° F.

10. The process of claim 7 wherein the flow rate of hydrogen exceeds the minimum required for complete tar sand reaction with hydrogen by a factor of about 21.

11. The process of claim 7 wherein the fluidizing hydrogen comprises make-up hydrogen and recycle hydrogen, and wherein the product stream includes recyclable unreacted hydrogen.

12. The process of claim 11 further comprising:

separating a gas mixture from the product stream, the gas mixture containing unreacted hydrogen;

purifying the gas mixture to form recycle hydrogen, wherein the recycle hydrogen contains substantially only unreacted hydrogen; and returning at least a portion of the recycle hydrogen to the reactor.

13. The process of claim 12 further comprising maintaining combined level of methane and ethane in the recycle hydrogen at 5% or less by pressure swing adsorption.

14. The process of claim 12 wherein the unreacted hydrogen and the recycle hydrogen pressures do not fall below about 450 psi.

15. The process of claim 12 further comprising the step of:

admixing make-up hydrogen with the recycle hydrogen prior to returning the recycle hydrogen to the reactor.

16. The process of claim 1 wherein the tar sand or shale continuously reacts with substantially only hydrogen in the fluidized bed at about 600 psi and a temperature of 900° F. to 1000° F.

17. The process of claim 1 wherein the tar sand or shale reacts with substantially only hydrogen by endothermic hydrocracking or exothermic hydrogenation or both.

18. A process for producing oil from a substantially dry tar sand or a substantially dry shale feed comprising:

introducing said feed in a fluidizable form into a fluidized bed reactor at a first temperature;

introducing a fluidizing hydrogen mixture into the fluidized bed reactor at a second temperature, wherein the second temperature is greater than said first temperature;

fluidizing said fluidizable feed by contacting the feed with the fluidizing hydrogen mixture to form a fluidized bed in the fluidized bed reactor heating said feed to a third temperature by contacting the feed with the fluidizing hydrogen mixture and thereby maintaining the fluidized bed at said third temperature, wherein said third temperature is between said first temperature and said second temperature;

continuously reacting the feed with substantially only hydrogen in the fluidized bed reactor at the third temperature and at about 600 psi pressure; and continuously discharging a product stream and spent solids from said fluidized bed reactor, wherein the product stream includes synthetic crude oil;

wherein the third temperature is between about 900° F. and about 1000° F.

19. The process of claim 18 wherein:

the feed is tar sand;

the first temperature is less than about 100° F.;

the second temperature is about 1500° F.; and the feed has a residence time in the reactor between about 5 and about 20 minutes.

20. The process of claim 19 wherein the fluidizing hydrogen mixture comprises at least about 95% hydrogen and wherein said hydrogen has a flow rate into the reactor between about 15 and about 26 times the flow rate required for complete tar sand reaction with hydrogen.

21. The process of claim 20 wherein the hydrogen flow rate into the reactor is 21 times the flow rate required for complete tar sand reaction with hydrogen, and wherein the third temperature is about 950° F.

22. The process of claim 20 wherein the feed is introduced into the reactor near the bottom of the fluidized bed reactor, and wherein spent solids are discharged near the top of the fluidized bed.

* * * * *